US008795589B1

(12) United States Patent
Furman et al.

(10) Patent No.: US 8,795,589 B1
(45) Date of Patent: Aug. 5, 2014

(54) BIO-BASED VOLATILE CORROSION INHIBITORS

(75) Inventors: Alla Furman, Shoreview, MN (US); Margarita Kharshan, Little Canada, MN (US); Ming Shen, Eagan, MN (US); Robert Kean, Minneapolis, MN (US)

(73) Assignee: Cortec Corporation, St. Paul, MN (US)

( * ) Notice: Subject to any disclaimer, the term of this patent is extended or adjusted under 35 U.S.C. 154(b) by 0 days.

(21) Appl. No.: 13/458,202

(22) Filed: Apr. 27, 2012

Related U.S. Application Data

(60) Provisional application No. 61/480,597, filed on Apr. 29, 2011.

(51) Int. Cl.
*C23F 11/02* (2006.01)

(52) U.S. Cl.
USPC ..... 422/9; 422/7

(58) Field of Classification Search
CPC ..... C23F 11/02
USPC ..... 422/7, 9; 106/14.05
See application file for complete search history.

(56) References Cited

U.S. PATENT DOCUMENTS

| | | | | |
|---|---|---|---|---|
| 3,952,705 | A * | 4/1976 | Witmer et al. | 119/51.03 |
| 4,668,416 | A | 5/1987 | Neal | |
| 4,851,149 | A | 7/1989 | Carandang | |
| 4,973,448 | A | 11/1990 | Carlson et al. | |
| 5,139,700 | A | 8/1992 | Miksic et al. | |
| 5,209,869 | A | 5/1993 | Miksic et al. | |
| 5,639,319 | A * | 6/1997 | Daly | 152/450 |
| 5,715,945 | A | 2/1998 | Chandler | |
| 6,028,160 | A | 2/2000 | Chandler et al. | |
| 6,149,834 | A | 11/2000 | Gall et al. | |
| 6,206,103 | B1 | 3/2001 | Zaid et al. | |
| 6,416,684 | B1 | 7/2002 | Bloomer | |
| 6,617,415 | B1 | 9/2003 | Miksic et al. | |
| 7,118,615 | B1 | 10/2006 | Miksic et al. | |
| 7,462,236 | B2 | 12/2008 | Chun et al. | |
| 7,658,861 | B2 | 2/2010 | Koefod | |
| 7,763,213 | B2 * | 7/2010 | Miksic et al. | 422/123 |
| 7,829,129 | B2 | 11/2010 | Behrens et al. | |
| 2009/0140202 | A1 * | 6/2009 | Takahashi | 252/188.28 |
| 2009/0302276 | A1 * | 12/2009 | Hartley et al. | 252/396 |

OTHER PUBLICATIONS

Caldwell, Dave "Molasses in Feeds"; Advances in Equine Nutrition II, 1998-2000; Kentucky Equine Research; 2001; p. 49-56.

* cited by examiner

*Primary Examiner* — Sean E Conley
*Assistant Examiner* — Donald Spamer
(74) *Attorney, Agent, or Firm* — Haugen Law Firm PLLP

(57) ABSTRACT

A volatile corrosion inhibitor may be in the form of, or derived from, molasses. Corrosion inhibition activity may be provided by molasses products, including molasses and/or any derivative product generated therefrom. Example molasses products include concentrated molasses, dehydrated molasses, molasses distillates or pot bottoms from distillation, extracted fractions of molasses, molasses fractions prepared by precipitation or membrane separation, and molasses residues remaining after removal of additional sugar or other targeted compounds. In one embodiment, the molasses-based corrosion inhibitor may be derived from sugar beet molasses.

4 Claims, 1 Drawing Sheet

| Fraction | Collecting Condition | Appearance | Odor | pH | Refractometer (nD) | Amt Collected / % starting material | VIA Grade (2.5 g for all distillation fractions) |
|---|---|---|---|---|---|---|---|
| Raffinate As Received | -- | | | 8.00 | Brix 60.5 | -- | Grade 2,2,3 when 2.5g Grade 2,3,3 when 5g |
| Trial 1: Temperature at top of distillation column never reached over 30°C and no discernible amount was condensed and collected. The highest temperature of liquid raffinate at the distillation flask reached 88°C while the heating medium water bath was boiling (~2hrs). The total experimental time was ~ 6 hours. | | | | | | | |
| Trial2 Distillate | * $T_t \leq 100°C$, collection period 1hr45min | Clear, slightly brown liq | Ammonium, shrimp smell | 8.70 | 1.3336 | 19.72g/17.74% | 3,2,2 |
| Trial2 Residue | | Dark brown thick liq | A bit malty, yeasty, slightly ammonium | 8.6 | Brix 36.7x2 (measure on 50% dilution) | 91.42g / 82.26% | 2,3,3 |
| Trial3 Distillate 1 | * $T_t$ 100 °C $T_b$ 104-113 Δ=4 to 13°C collection time 1hr20min | Clear liq | Strong, burnt acrid | 7.84 | 1.3334 | 44.87g /22% | 3,2,2 |
| Trial3 Distillate 2 | * $T_t$ 100 °C $T_b$ 117-127 Δ=17 to 27°C collection time 1hr45min | Clear liq | Stronger burnt, acrid | 8.27 | 1.3344 | 14.88g/7.3% | 3,3,2 |
| Trial3 Residue | Distillation was terminated when residue was foaming excessively | Glue-like dark brown mass, ribbon-like when stirred | Strong burnt acrid at first. Malty, soy paste-like the 2nd day | 7.6 @ 46% in water | Brix 45.8x2 (measure on 50% dilution) | Total distillates collected ~29% Residue contains ~10% water (starting water% =39%) | 3,3,3 |

BIO-BASED VOLATILE CORROSION INHIBITORS

CROSS-REFERENCE TO RELATED APPLICATIONS

This application claims priority to U.S. Provisional Patent Application Ser. No. 61/480,597, filed on Apr. 29, 2011 and entitled "Bio-Based Volatile Corrosion Inhibitors," the content of which being incorporated herein in its entirety.

FIELD OF THE INVENTION

This invention relates to volatile corrosion inhibitors prepared from bio-based materials, particularly molasses products.

BACKGROUND OF THE INVENTION

In commerce and industry today, the useful life of corrodible items may be extended and/or preserved by providing corrosion inhibitors which protect the corrodible item from the adverse effects of its ambient environment. Elements or compounds which are normally of primary concern are gases such as oxygen, water vapor, sulfides, carbon dioxide, aqueous aerosols containing salts or acids, and the like. Among the common indications of corrosion manifested in useful metallic articles are oxidation, pitting, tarnishing, mottling, or discoloration of the surfaces of these items. Metals which are frequently found to be susceptible to corrosion under normal atmospheric and ambient conditions are iron, copper, brass, aluminum, silver, and alloys of these metals. Corrosion inhibitors, particularly vapor phase corrosion inhibitors, have been found useful in protecting certain corrodible items against reaction with elements or compounds which may be found within their environment, and thereby losing their effectiveness, reducing their useful life, or otherwise diminishing their value. Such protection is typically needed during times of packaging, handling, shipment, or during end use.

In the past, it has been known to provide a package or other enclosure which includes one or more inhibiting compounds along with the corrodible item or items to be protected. Additionally, articles have been protected from corrosion by means of protective coatings in the form of solids, liquids, greases, or pastes. However such coatings tend to provide only temporary benefit, and may present certain disadvantages to normal handling and packaging. Furthermore, removal of such protective coatings may be needed prior to article use, and such removal may present problems either due to incomplete removal, or the costs of such removal.

Solid phase and liquid phase compounds have been used in the past as vapor phase corrosion inhibitors. These materials typically have sufficient volatility to either evaporate or sublime to provide a substantially constant availability of the vapor phase inhibitors. In other words, volatile corrosion inhibitors typically emit vapors which protect corrodible surfaces through the deposition or condensation of a protective film or coating upon the surface. In order to be assured that a constant supply of inhibitor be present, adequate quantities of the solid phase or liquid phase corrosion inhibiting compounds must be provided, with the corrosion inhibiting compounds being released at or adjacent to the treatment location. Examples of vapor phase corrosion inhibitors and delivery vehicles for such inhibitors may be found in U.S. Pat. Nos. 4,973,448, 5,139,700, 5,209,869, 5,715,945, 6,028,160, 6,617,415, and U.S. Pat. No. 7,118,615, herein incorporated by reference. While some current vapor phase corrosion inhibitors are non-toxic and environmentally benign, many originate from non-renewable petrochemical feed stocks, which are viewed negatively by some consumer segments. Therefore, there is need for bio-based vapor phase corrosion inhibitors sourced from renewable resources, particularly if such materials are of equivalent or lower cost than currently available products. While several bio-based/renewable materials have shown corrosion inhibitor properties when used in de-icer compositions (see for example U.S. Pat. Nos. 4,668,416, 6,149,834, 6,416,684, and 2009/0302276), we have not found any reference or suggestion indicating that biological or agricultural materials could be used as vapor phase corrosion inhibitors. Thus, it has been surprisingly found that molasses products can be used as vapor phase corrosion inhibitors.

SUMMARY OF THE INVENTION

By means of the present invention, the problem of manufacturing cost-effective, bio-based volatile corrosion inhibitors is solved by use of molasses products. Combined with the use of solid absorbent materials, these corrosion inhibitors can be used in conventional articles to provide corrosion protection of metals.

BRIEF DESCRIPTION OF THE DRAWINGS

FIG. 1 is a table of the testing results of treated sugar beet raffinate.

DETAILED DESCRIPTION OF THE PREFERRED EMBODIMENTS

The objects, features, and advances represented by the present invention will now be presented in terms of detailed embodiments. Other embodiments and aspects of the invention are recognized as being within the grasp of those having ordinary skill in the art.

The term molasses historically referred specifically to the final residue obtained in the preparation of sucrose by repeated evaporation, crystallization and centrifugation of juices from sugar cane or from sugar beets. Today, several types of molasses are recognized and in general, any liquid feed ingredient that contains in excess of 43% sugars may be referred to as molasses. The term "molasses", as used herein to describe this invention shall refer to, but is not limited to, any products commonly sold as molasses, regardless of specific source. Molasses is commonly used as an animal feed. While molasses can be quite variable in composition, standardization of compositional specifications has allowed several types of molasses to be traded as commodities.

The Association of American Feed Control officials (AAFCO, 1982) describes the following types of molasses.

Cane Molasses is a by-product of the manufacture or refining of sucrose from sugar cane. It must not contain less than 46% total sugars expressed as invert, which is a measure of total sugar after they have been completely hydrolyzed to monomers. If its moisture content exceeds 27%, its density determined by double dilution must not be less than 79.50 Brix.

Beet Molasses is a by-product of the manufacture of sucrose from sugar beets. It must contain not less than 48% total sugars expressed as invert and its density determined by double dilution must not be less than 79.50 Brix.

Citrus Molasses is the partially dehydrated juices obtained from the manufacture of dried citrus pulp. It must contain not less than 45% total sugars expressed as invert and its density determined by double dilution must not be less than 71.00 Brix.

Starch Molasses is a by-product of dextrose manufacture from starch derived from corn or grain sorghums where the starch is hydrolyzed by enzymes and/or acid. It must contain not less than 43% reducing sugars expressed as dextrose and not less than 50% total sugars expressed as dextrose. It shall contain not less than 73% total solids.

Hemicellulose Extract, a by-product of the manufacture of pressed wood, is also considered a molasses for purposes of this invention. It is the concentrated soluble material obtained from the treatment of wood at elevated temperature and pressure without use of acids, alkalis, or salts. It contains pentose and hexose sugars, and has a total carbohydrate content of not less than 55%.

Molasses can be further processed and fractionated. Beet molasses in particular is usually further processed to remove additional sugar. The resulting concentrate is frequently called raffinate or Concentrated Separator Byproduct (CSB). Is this process, betaine (an amino acid derivative) is sometimes recovered as an additional product.

The term "molasses products", as used herein, shall mean any type of molasses or any derivative product made by processing of molasses, including materials produced by sequential treatments or separations of molasses derivatives. Molasses products include, but are not limited to, concentrated molasses, dehydrated molasses, molasses distillates or pot bottoms from distillation, fractions obtained by chromatographic or ion exchange separation of molasses, extracted fractions of molasses, molasses fractions prepared by precipitation or membrane separation, and molasses residues remaining after removal of additional sugar or other targeted compounds.

"Vapor phase corrosion inhibitor", as used herein, refers to a material which has the ability to migrate in the vapor phase to provide corrosion inhibition to remote metal surfaces. Often, a mixture of materials is used to balance protection properties and/or cost.

"Volatile corrosion inhibitor", (abbreviated VCI) as used herein, means a material that emits a vapor phase corrosion inhibitor.

"Corrosion inhibitor", as used herein, refers to a material that produces measurably reduced corrosion compared to an equivalent environment absent the material. In some cases, a material that produces Grade 2 or Grade 3 corrosion protection in the VIA test is an indicator of a commercially effective quantity of a volatile corrosion inhibitor.

It has been surprisingly found that molasses and a wide variety of molasses products show activity as volatile corrosion inhibitors. Molasses typically contains a very large number of different chemical species, many of which are volatile. These chemical species appear to originate predominantly from thermal and chemical reactions between organic acids, proteins/peptides, and sugars/carbohydrates originally extracted from the source material.

In some embodiments of this invention, ammonia or amines or their salts may be added to the molasses products. In some cases, this has been demonstrated to enhance the corrosion inhibiting properties. Examples include but are not limited to ammonia, ammonium hydroxide, monoethanol amine, dimethyl ethanolamine, diethyl ethanolamine, cyclohexyl amine, dicyclohexylamine, and isopropanolamine. In general, lower molecular weight amines are expected to provide greater effect.

In some embodiments of this invention, a solid absorbent material is used to absorb and contain the molasses products. This solid absorbent material may be in any suitable form, such as powder, granular, fibrous, or articles such as rods, sheets, strips, woven or non-woven pads, foam, etc. Examples of potentially useful materials include silicon dioxide, flour, sand, talc, diatomaceous earth, clay, vermiculite, pearlite, peat moss, coir, starch, ground corn cobs, feathers, seed hulls, shredded bark, sawdust, wood chips, cellulose fibers, paper, superabsorbent polymer, cotton fibers or fabrics, polyester non-woven fabrics or pads, fiberglass, open cell polyurethane foam, etc. For some embodiments, silicon dioxide is a preferred absorbent material, as it absorbs a large amount of molasses products per weight of absorbent material and the resulting mix has a desirable texture for mechanical handling.

An article for delivering volatile corrosion inhibitor to a confined space may be fabricated by using molasses products absorbed on a solid absorbent substrate material. In some embodiments, the solid substrate and molasses products are contained in a receptacle which is substantially impermeable to the solid absorbent material, but at least a portion of which is permeable to the vapor phase corrosion inhibitor. Examples of such articles include emitter cups and pouches. An emitter cup is typically a small plastic cup which is partially filled with a solid volatile corrosion inhibitor. The opening is then covered with a vapor permeable membrane (e.g. Tyvec®) which is thermally sealed to the rim of the cup to contain the solid but to permit emission of vapors out of the cup. Such cups are typically enclosed in an outer impermeable package (to contain all of the corrosion inhibitor) until ready to use. An emitter cup is typically used in an enclosure or package to provide ongoing corrosion protection to the contents for up to about 2 years. Pouches are typically small sealed bags made of Tyvec® or other vapor permeable, but solid impermeable material. Pouches accomplish a similar function to emitter cups but are typically used in situations where a relatively large quantity of VCI is required. It is preferable to select a material for pouch construction (and emitter cup lids) which is relatively tear and puncture resistant, and which does not lose structural integrity if it becomes wet. Molasses absorbed, for example, on a piece of paper, foam, fabric, or non-woven material may be used directly as an article; often used with an adhesive strip to secure to the interior of an enclosure. Such articles may also include a vapor permeable outer covering to prevent direct contact between the molasses products and the contents of the enclosure.

The term "Biodegradable", as herein applied to polymers, or articles made from polymers, refers to materials that meet established criteria for biodegradation. The most commonly recognized tests for biodegradable polymer materials are ASTM D-6400 and ISO-14855. Lactic acid polymers are generally biodegradable per the above referenced tests, as are most plasticized and modified starch materials. Some examples of other biodegradable polymers that are suitable for use in the present invention include: polyesters composed of aliphatic dicarboxylic acids and aliphatic diols (such as polyesters composed primarily of butanediol, with adipic acid and/or succinic acid); aromatic-aliphatic copolyesters (such as polyesters composed primarily of butanediol, with adipic acid and/or succinic acid and small amounts of terephthalic acid); polyglycolic acid/polyglocolide; polycaprolactone; polyesteramides formed by reaction of at least one diacid, one diol and one amino acid; thermoplastic starches; and polyhydroxy alkanoates (such as poly hydroxybutyrate and polyhydroxyvalerate); poly(p-dioxanone); polyurethanes (such as those based on degradable polyesters); polyvinyl alcohol; polyestercarbonates; and poly(ethylene glycol). For some embodiments of the invention, it may be desirable that the final article, including any solid absorbent, enclosure, and packaging materials, be biodegradable.

Some embodiments of the present invention may also be "compostable" as determined by standard methods such as ASTM D-6400.

Renewable or bio-based content generally refers to percentage of a commercial or industrial product that is derived from biological products or renewable domestic agricultural materials (including plant, animal, and marine materials) or forestry materials. Tests for bio-based content include for example ASTM D-6866. Examples of polymers with bio-based content that are suitable for the present invention include: cellulose derivatives (e.g. cellulose acetate butyrate), starch derivatives (e.g. hydroxypropylated starch sold as Plantic®), polyethylene made starting from ethanol (e.g. Dowlex bio-LLDPE), furfural based polymers, poly(trimethylene teraphthalate) (37% bio-based, sold as Sorona®, by DuPont) etc. Many of the biodegradable polymers listed above are also bio-based polymers. For purposes of this invention, the terms "bio-based" and "renewable" are used interchangeably. For some embodiments of the invention, it may be desirable for the final article, including any solid absorbent, enclosure, and packaging materials, to have a high bio-based content.

The following examples illustrate the invention, but are not intended to limit it in any way.

EXAMPLES

Vapor Inhibitor Ability (VIA) is tested according to a variation of Federal Standard 101C, Method 4031, Procedure B.

In brief, a sample containing vapor phase inhibitor is placed for 2 hours in proximity to a clean, freshly polished surface of steel (Carbon steel plugs; SAE 1010 CR 22 S 698 ⅝"×½" hollow, METASPEC Co) in a container at 40° C. and a controlled relative humidity (VIA solution of 3% glycerol in the bottom of the jar). Samples are then visually inspected relative to a control sample and graded from 0 to 3 with 0 indicating no corrosion inhibition and 3 indicating good corrosion inhibition. A score of 2 or 3 is considered passing. Samples are preferably run in triplicate (three "plugs") to provide increased confidence in the results.

Example 1

Sugar Beet and Cane Molasses and Sugar Beet Raffinate

Samples of 5 g or 2.5 g of molasses or raffinate as received were placed in a small dish at the bottom of respective VIA jars and tested for corrosion protection under VIA protocol. The cane molasses samples were obtained commercially (under the Brer Rabbit brand). The sugar beet molasses and raffinate samples were obtained from a sugar beet processing facility.

TABLE 1

| Sample | Plug #1 | Plug #2 | Plug #3 |
|---|---|---|---|
| 5 g Sugar Beet raffinate | Grade 2 | Grade 3 | Grade 3 |
| 5 g Sugar Beet molasses | Grade 1/0 | Grade 3 | Grade 3 |
| 5 g Cane molasses (black strap) | Grade 2 | Grade 2 | Grade 1 |
| 5 g Cane molasses (full flavor) | Grade 2 | Grade 0 | Grade 0 |
| 2.5 g Sugar Beet raffinate | Grade 2 | Grade 2 | Grade 3 |
| 2.5 g Sugar Beet molasses | Grade 2 | Grade 2 | Grade 3 |
| Control | Grade 0 | — | — |

Example 2

Sugar Beet Raffinate Heating and/or Distillation

A distillation approach was attempted as a possible means to concentration volatile corrosion inhibitors found in the molasses products. Three different trials for treating sugar beet raffinate were conducted with set-up and processing conditions as described below:

Trial 1:

The apparatus used for Trial 1 included a 500 ml round bottom, single neck flask and an Allihn type distillation column with a 20 inch jacket length. A coil-type condenser with a 25.5 inch jacket length was connected to the distillation column with a T-shaped connecting elbow with a distance "H" from the flask neck to the condenser=8 cm. A 100 ml round bottom flask distillate collector was connected to the condenser with an L-shaped connecting elbow to form a closed system. Trial 1 was performed with the system under the following conditions:

| Heating Method | Cooling Method | Temperature of Heating Medium | Temperature of Residue in Bottom Flask (T-b) | Temperature of Vapor Before Condensing (T-t) | Amount of Starting Raffinate |
|---|---|---|---|---|---|
| Water Bath | Tap Water | Highest = 100° C. | Highest = 88° C. | Highest = 30° C. | Not Recorded |

Trial 2:

The apparatus used for Trial 2 included a 250 ml flat bottom, single neck flask and an Allihn type, 20 inch jacket length distillation column. A coil-type 25.5 inch jacket length condenser was connected to the distillation column with a T-shaped connecting elbow with H=8 cm. A 100 ml round bottom flask distillate collector was connected to the condenser with an L-shaped connecting elbow to establish a closed system. Trial 2 was performed under the following conditions, with the sample being heated for about 10 minutes before beginning distillate collection:

| Heating Method | Cooling Method | Temperature of Heating Medium | Temperature of Residue in Bottom Flask (T-b) | Temperature of Vapor Before Condensing (T-t) | Amount of Starting Raffinate |
|---|---|---|---|---|---|
| Direct on Heat Plate | Tap Water | N/A | Not Measured | 90-100° C. | 111.14 g |

Trial 3:

The system for Trial 3 employed a 500 ml round bottom, double neck flask and an Allihn type, 20 inch jacket length distillation column. A coil-type, 25.5 inch jacket length condenser was connected to the column with a T-shaped connecting elbow with H=8 cm. A 100 ml round bottom flask distillate collector was connected to the condenser with an L-shaped connecting elbow. Trial 3 was performed under the following conditions, with the sample being heated for about one hour before beginning distillate collection:

| Heating Method | Cooling Method | Temperature of Heating Medium | Temperature of Residue in Bottom Flask (T-b) | Temperature of Vapor Before Condensing (T-t) | Amount of Starting Raffinate |
|---|---|---|---|---|---|
| Sand Bath | Tap Water | 290-296° C. | Highest = 127° C. | Highest = 100° C. | 203.4 g |

The treated sugar beet raffinate from Trials 1-3 were analyzed, with the results listed in FIG. 1.

Note that $\Delta=T_b-T_t$. The term "distillate" refers to material that vaporizes from the heated flask, condenses in the chilled condenser, and is collected as a liquid at the output of the condenser. For Trial 3, two distillate fractions were collected sequentially, to determine if the distillation proceeds uniformly over time or whether certain more volatile components are distilled first, followed by different volatile materials. The term "residue" refers to the material remaining in the pot bottom, which is presumably non-volatile or at least less volatile than the distillates. Water appears to be the major component of the distillates, and thus the residue is reduced in water content compared to the starting material.

Distillates all showed corrosion inhibition equivalent to or better than the starting material, validating the volatile nature of the corrosion inhibiting species in the raffinate. Surprisingly, both of the distillation residues also showed better vapor phase corrosion inhibition than the starting materials. Several fractions displayed a strong burnt, ammonium/malty odor. The VIA jars (particularly the lids) exposed to these substances carry the odor even after regular wash, soaking in hot soapy water for hours, and rinsing with methanol and acetone. However, the odor didn't appear to have corrosion inhibiting property since the control sample of the VIA test carried out in those jars still corrode similarly to jars without the odor.

Example 3

Sugar Beet Raffinate Treatment with Cation Exchange

Sugar beet Raffinate has a pH of about 7.5-8.0 (as measured by a pH meter). It is recognized in the art that, potassium is an inorganic ion present in sugar beet raffinate at about 6.5% by weight (which calculates to about 2.54 moles/liter). From published data and titration curves, sugar beet raffinate appears to contain organic acids (as salts or free acids). An attempt to enhance the corrosion inhibition activity of the raffinate was performed by conversion of the intrinsic potassium salts to ammonium salts. The conversion was accomplished as described below in a two step process. First, the raffinate was treated with an acid form cation exchange resin to absorb potassium ions from the raffinate and release hydrogen ions (thus lowering the pH). Three different levels of treatment were tested, with the third level targeting almost complete exchange of hydrogen for potassium, and the other two levels yielding partial exchange. After removing the ion-exchange resin (by decanting), ammonium hydroxide was added to the treated raffinate to raise the pH to about 9.8, thus converting most of the organic acids present to ammonium salts.

Dowex HCR-W2 H+ form, strong acid cation exchange resin (J. T. Baker), ~1.9 meq/ml (wet volume), was used after washing with deionized water until no color was observed in the wash liquid.

Sample 3-1: Approximately 5 ml of sugar beet raffinate was diluted to 10 ml (providing about 30% solids). Wet cation exchange resin was added until the pH dropped to 5.6 (from 7.7), The resin was removed and the liquid portion was saved as sample 3-1. Total resin used was about 1 ml.

Sample 3-2: Approximately 5 mL of sugar beet raffinate was diluted to 10 ml, as in sample 3-1. Wet cation exchange resin was added until the pH dropped to 4.03 (required about 2.5 ml of resin). The resin was removed and the liquid portion was saved as sample 3-2.

Sample 3-3: Approximately 5 mL of sugar beet raffinate was diluted to 10 ml, as in sample 3-1. Wet cation exchange resin was added until the pH dropped to 1.95 (required about 7 ml of resin). The resin was removed and the liquid was saved as sample 3-3. About 7.9 ml of resin would be required to exchange all of the cations in the raffinate sample (~1.6 ml of resin per ml of starting raffinate), which by published compositional data is expected to be largely potassium ions and some nitrogen containing organic cations.

Samples were tested under the VIA protocol after adjusting to ~9.8 pH with ammonium hydroxide. For comparison, a sample of raffinate with 5% added ammonium hydroxide solution (about 30% ammonia) was included. The raffinate sample is undiluted, so the applied weight was adjusted to be comparable to the 0.62 gram ion exchange samples. The results were as seen in the following Table 2:

TABLE 2

| Sample | Initial pH | Wt (g) | VIA Result |
|---|---|---|---|
| 3-3 | 1.94 | 2.5 | 3, 3, 3 |
| 3-2 | 3.93 | 2.5 | 3, 3, 3 |
| 3-1 | 5.53 | 2.5 | 2, 2, 3 |
| 3-3 | 1.94 | 0.62 | 2, 2, 2 |
| 3-2 | 3.93 | 0.62 | 2, 2, 2 |
| 3-1 | 5.53 | 0.62 | 0, 1, 0 |
| Raffinate + 5% ammonium hydroxide | | 0.3 | 2, 2, 2 |

The above treatments showed improved corrosion inhibition under the VIA protocol, compared to untreated Raffinate (see Example 1, noting that samples 3-1 through 3-3 are about one half of the concentration of the untreated raffinate). However, addition of ammonium hydroxide, without ion exchange, produces similar improvements.

Example 4.1

Enhancing the VCI Activity of Sugar Beet Raffinate and Molasses

Additions of 20%, 10% 5% by weight of ammonium hydroxide solution (~30% ammonia) to sugar beet raffinate and molasses were tested. It was found that addition of 5% by weight ammonium hydroxide solution was as effective for corrosion inhibition as additions of 10% or 20%. Addition of 5% by weight monoethanolamine to sugar beet raffinate and molasses was also tested. It was as effective for corrosion inhibition as the 5% by weight ammonium hydroxide samples in the VIA test. Ammonium hydroxide by itself showed almost no corrosion inhibition in VIA tests.

Example 4.2

Enhancing the VCI Activity of Cane Molasses

The cane molasses samples from Example 1 were further tested with the additions of 5% by weight of ammonium hydroxide solution (~30% ammonia). The data in the table below show significant enhancements to the VIA activity with addition of the ammonium hydroxide solution. It was noted that only 1 gram of the ammonium hydroxide enhanced material exhibited higher corrosion inhibition activity than 5 g of the molasses sample tested as is, though the molasses sample, alone, provided acceptable corrosion inhibition.

| Sample | $NH_4OH$ sol | Plug #1 | Plug #2 | Plug #3 |
|---|---|---|---|---|
| 5 g Cane molasses (black strap) | 0% | Grade 2 | Grade 2 | Grade 1 |
| 1 g Cane molasses (black strap) | 5% | Grade 3 | Grade 3 | Grade 3 |
| 5 g Cane molasses (full flavor) | 0% | Grade 2 | Grade 0 | Grade 0 |
| 1 g Cane molasses (full flavor) | 5% | Grade 2 | Grade 2 | Grade 3 |
| Control | | Grade 0 | — | — |

Example 5

Enhanced Sugar Beet Molasses in Solid Form

Example 5.1

Enhanced sugar beet molasses, created through addition of ammonium hydroxide solution at 5% by weight, was further tested for contact corrosion protection with a "razor blade" test. In brief, the "razor blade" test involves carbon steel panels composed of 1010 carbon steel and 100% copper panels measuring one inch by four inches, which are both cleaned in methanol. Corrosive solutions were placed on the surface of these metal panels with or without the presence of corrosion inhibitors. After a designated period of time, the surfaces are wiped off, and observed for any signs of corrosion. The results show that "enhanced" molasses provided contact corrosion protection for carbon steel but not for copper. With further addition of 2% benzotriazole by weight, the enhanced molasses also provided corrosion protection for copper.

Example 5.2

The enhanced molasses from Example 5.1 was converted into solid powder/crumb form for ease of handling. Silicon dioxide (amorphous precipitated silica, Sipernat 50S, Evonik), wheat flour, and play sand were tested as possible absorbents for the enhanced sugar beet molasses. Powders made from wheat flour and silicon dioxide showed the same good corrosion inhibition (grade 3.3.3 in VIA test on equivalent of 1 g enhanced molasses), while play sand showed slightly less ideal results (grade 2.2.2). Silicon dioxide was determined to be the preferred absorbent due to its handling property, high surface area, and light weight. The enhanced molasses takes on powder/crumb form when silicon dioxide was added at weight ratio of 1:4 (silicon dioxide:liquid).

Example 5.3

The resulting crumb/powder from Example 5.2 was dried to further enhance its potency. The moisture loss was in the range 12-16%, either through drying overnight at 40 degree C. or 20 min at 120 degree C. A sample of 0.5 g of the dried powder achieves grade 3.3.3 in the VIA test.

Example 5.4

An aging or exhaustion test was conducted on the enhanced molasses powder from Example 5.2 by subjecting 2 g of freshly prepared enhanced molasses powder (with silicon dioxide as absorbent) to the Exhaustion Test per MIL I-22110C Standard for qualifying QPL (Temperature=100 F, RH=50%, Air flow rate=100 cc/min, 5 days). VIA tests were performed on the aged powders in the following manner: for 2 bottles, 10 ml of 3% glycerol solution was introduced directly to the bottle (thus powder was wet in solution); for another 2 bottles, 10 ml of 3% glycerol solution was introduced in a small cup (thus powder was not wet). VIA results were 3.3 on dry powder, 2.0 on wet material.

Example 6

Emitter Cup Based on VCI-Enhanced Molasses Powder

Approximately 7 g of dried enhanced beet molasses powder from Example 5.2 (on silicon dioxide absorbent) was sealed in a plastic cup (~1¾ inches in diameter, ~⅝ in deep) with a heat sealed Tyvec® membrane. The VIA test on emitter cup yielded grade 3.3.3 plugs. These results are comparable to a commercial product offered by Cortec Corporation, VpCI-105, which is based on conventional volatile corrosion inhibitors.

Example 7

Membrane Fractionation of Sugar Beet Molasses Raffinate

Regenerated Cellulose Ultrafiltration Membranes with molecular weight cutoffs of: 30,000, 10,000, 3000, and 1000 (Millipore), were used with a Stirred Ultrafiltration Cell (Model 8400 Millipore).

A diluted solution of beet molasses raffinate/DI-water was made in 1/1 ratio by weight. A diluted solution of raffinate distillation residue (from Example 2, Trial 3)/DI-water was made in 1:3 ratio by weight. Ultrafiltration was carried out according to the manufacturer's instruction. Compressed nitrogen, at 50-60 psi, was used as a pressure source over the solution in the stirred cell. The prepared solution was subject to sequential ultrafiltration, resulting in fractions of nominal molecular weights (NMW) above 30,000, between 30,000-10,000, between 10,000-3000, between 3000-1000, and below 1000. VIA tests were conducted on each of the above resulting fractions to assess whether the fraction has enhanced volatile corrosion inhibitor activity. Non volatile content (NVC) of each fraction was determined by evaporation of an aliquot to dryness, and measurement of the mass difference. Results obtained for drying at 40° C. (for ~40 hours) or 120° C. (for about 20 minutes) agreed within about 2%. All VIA tested samples contained 0.5 g of solids, based on measured NVC of each fraction.

The fraction containing NMW above 30,000 showed some enhanced volatile corrosion inhibitor activity. The fraction containing NMW between 3000-1000 showed more pronounced corrosion inhibitor activity. The other fractions showed reduced activity relative to the starting materials. This is true for either raffinate as-received or raffinate distillation residue.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A method for protecting metal from corrosion, said method comprising contacting the metal with an effective amount of vapors from a molasses product to inhibit corrosion of the metal, wherein said effective amount of vapors produces at least Grade 2 corrosion protection in a vapor-inhibiting ability (VIA) test.

2. A method as in claim 1 wherein said molasses product is contained within an enclosure.

3. A method as in claim 2 wherein said metal forms part of said enclosure.

4. A method as in claim 2 wherein said enclosure is vapor permeable and solid and liquid impermeable.

* * * * *